US007473832B2

(12) United States Patent
Wanne

(10) Patent No.: US 7,473,832 B2
(45) Date of Patent: Jan. 6, 2009

(54) MOUTHPIECE ASSEMBLY FOR SAXOPHONE AND OTHER SIMILAR INSTRUMENTS

(75) Inventor: Allen Theodore Wanne, Bellingham, WA (US)

(73) Assignee: Wanne, Inc., Bellingham, WA (US)

( * ) Notice: Subject to any disclaimer, the term of this patent is extended or adjusted under 35 U.S.C. 154(b) by 120 days.

(21) Appl. No.: 11/538,892

(22) Filed: Oct. 5, 2006

(65) Prior Publication Data

US 2008/0083316 A1 Apr. 10, 2008

(51) Int. Cl.
*G10D 9/02* (2006.01)

(52) U.S. Cl. ..... 84/383 R

(58) Field of Classification Search ..... 84/383 R, 84/383 A, 380 R, 385 A, 398, 399
See application file for complete search history.

(56) References Cited

U.S. PATENT DOCUMENTS 1,789,639 A * 1/1931 Selmer ..... 84/383 R
4,210,055 A * 7/1980 Platamone, Jr. ..... 84/383 R
6,130,376 A * 10/2000 Chang ..... 84/383 R

* cited by examiner

*Primary Examiner*—Kimberly R Lockett
(74) *Attorney, Agent, or Firm*—Gottlieb, Rackman & Reisman

(57) ABSTRACT

A mouthpiece assembly includes a tubular member with two longitudinal portions, and a ligature for attaching a reed to the tubular member. The ligature and the mouthpiece are structured to define several discrete positions that can be selected by a musician.

7 Claims, 3 Drawing Sheets

MOUTHPIECE ASSEMBLY FOR SAXOPHONE AND OTHER SIMILAR INSTRUMENTS

RELATED APPLICATIONS

None.

BACKGROUND OF THE INVENTION

A. Field of Invention

This invention pertains to musical instruments with removable mouthpiece assemblies, and more particularly to a novel assembly wherein the ligature has several positions spaced along a longitudinal axis of a mouthpiece.

B. Description of the Prior Art

Woodwind instruments are instruments consisting of a tubular body used to define a column of air. As is well known in the art, sound waves are produced within the column of air and the musical characteristics of the sounds, including pitch, volume and other characteristics are modulated by changing the acoustic characteristics of the column. More specifically, a mouthpiece is attached by a friction fit to an end of the tubular body. The mouthpiece has a cavity in communication with the interior of the tubular body. A reed covers the cavity and is arranged so that when a musician blows through the mouthpiece, the reed oscillates and produces vibrations which are then propagated through the cavity in the mouthpiece to the tubular body. The reed is secured to the mouthpiece by an adjustable metal band known as the ligature.

The ligature normally extends circumferentially around the entire outer body of the mouthpiece. The ligature is provided with an integral tightening mechanism that is used to secure the reed to the mouthpiece. Because of the mechanical coupling between the ligature, the mouthpiece and the reed, the structure of the ligature plays a roll in the sound produced by the instruments, and various types of ligatures are available from different companies, each having its own sound characteristics. FIGS. 3 and 4 show some known prior art mouthpieces and ligatures for saxophones.

SUMMARY OF THE INVENTION

A mouthpiece assembly includes a tubular mouthpiece a sidewall formed with a longitudinal portion and a ligature for securing a reed to the mouthpiece. The mouthpiece and the ligature are sized and shaped to define a plurality of discrete positions for the ligature. The ligature can secure the reed at each of its positions in a manner that allows the reed and the ligature to vibrate during play. In one embodiment, the mouthpiece has a longitudinal portion formed with spaced holes. The ligature includes a movable shaft that can be selectively inserted and retrieved from the holes to adjust the position of the ligature or remove it. Preferably, the holes are oversized so that the shaft fits loosely into the holes. The ligature has a threaded transversal hole and the shaft is threaded and is positioned in the transversal hole so that it can be selectively advanced into, or retracted from the holes in the mouthpiece.

DETAILED DESCRIPTION OF THE INVENTION

Figure 3:
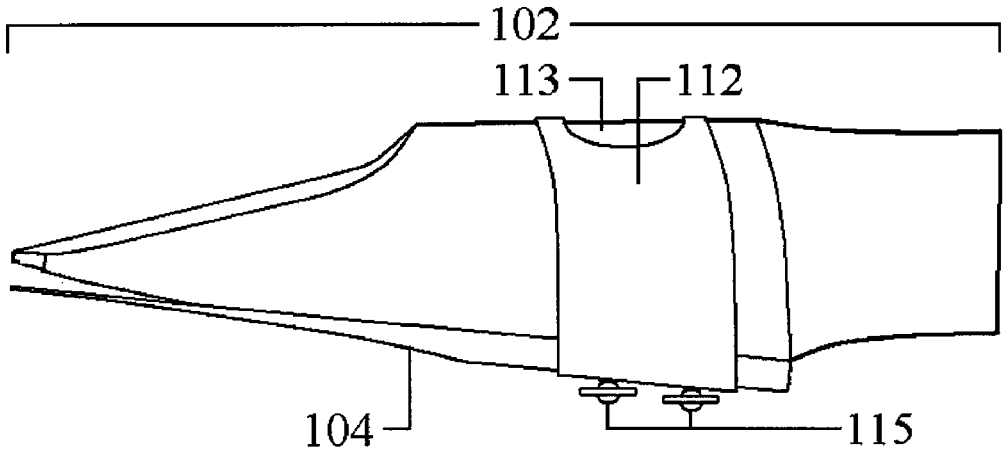
FIG 3 PRIOR ART
FIG. 3 shows a side view of a mouthpiece with a prior art ligature.
Figure 4:
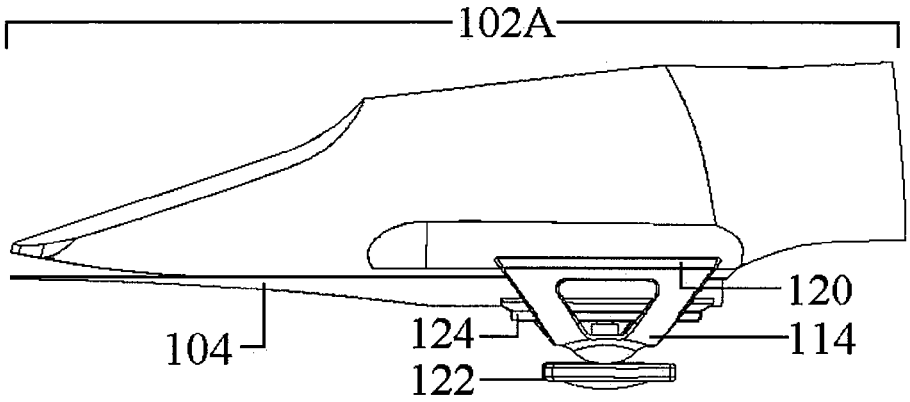
FIG 4 PRIOR ART
FIG. 4 shows a side view of a mouthpiece with another type of prior art ligature.

In order to provide a better understanding of the invention, some prior art ligatures are first discussed. Referring first to FIG. 3, a typical mouthpiece 102 is shown with a reed 104. The reed 104 is secured to the mouthpiece 102 with a ligature 112. The ligature 112 has a round hole 113 at the top and is tightened with two screws 115. The reed 104 is secured to the mouthpiece 102 by the ligature 112. FIG. 4 shows a different ligature 114. While the ligature 112 is a closed ring or band, the ligature 114 extends only partially beneath the mouthpiece. There this ligature 114 is useable only with a mouthpiece 102A that has two longitudinal grooves or ledges 116 (only the near groove being visible in the Figure). The ligature includes a body 114 with two legs 120 (one of these being shown in the Figure) seated in the respective groove 116. The ligature 114 further includes a thumb screw 122 riding on, or biasing a rail 124. When the thumb screw 122 is tightened, it bears against the rail 124 which in turn engages and secures a distal end of reed 104. The ligature has some limited movement in the longitudinal direction along the mouthpiece 102A.

It is well known that the position of the ligature on the mouthpiece has an effect on the sound produced by the respective instrument and therefore, once a musician locates the ligature position on a particular instrument, he would like to be able to mount the ligature in exactly the same position. A problem with the prior art ligatures, such as the two shown in FIGS. 3 and 4, is that the ligature is maintained in place by an interference fit with the external surface of the mouthpiece, and once they are loosened, they can be freely shifted longitudinally along the mouthpiece to several non-discrete positions. As a result, once a ligature is removed, it is very hard for the musician to place a ligature exactly to an optimum or predetermined position. Moreover, because the ligatures are held by friction, during use, they do loosen up occasionally and move or shift longitudinally to new positions that are undesirable. These problems are resolved by the present invention.

Also, in the attempt to hold the ligature in place previous art ligatures utilize large surface areas of tight contact with the mouthpiece body 102. Not only does this only moderately work, but most importantly the vibrations of the reed/ligature combination are dampened by the mouthpiece body 102 creating a severely deadening affect on the resultant sound produced by the mouthpiece.

Figure 1:
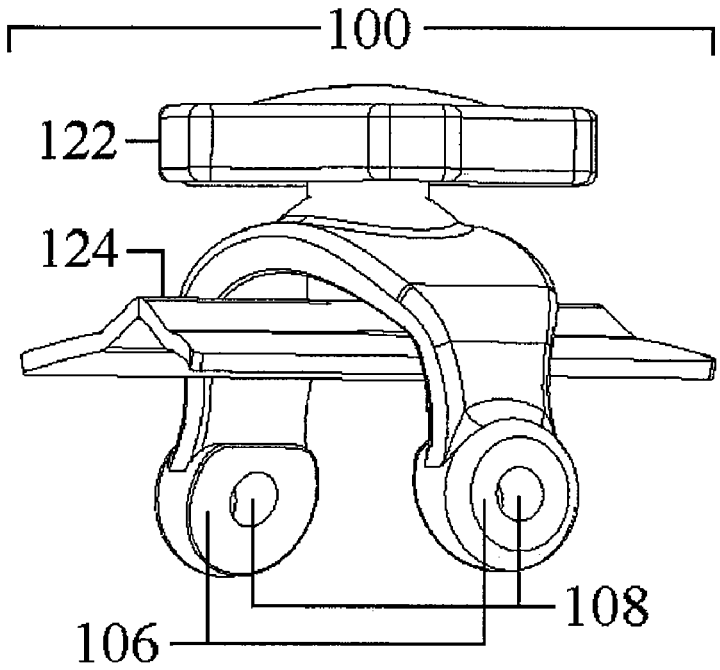
FIG. 1 shows an orthogonal view of a ligature constructed in accordance with this invention.
Figure 2:
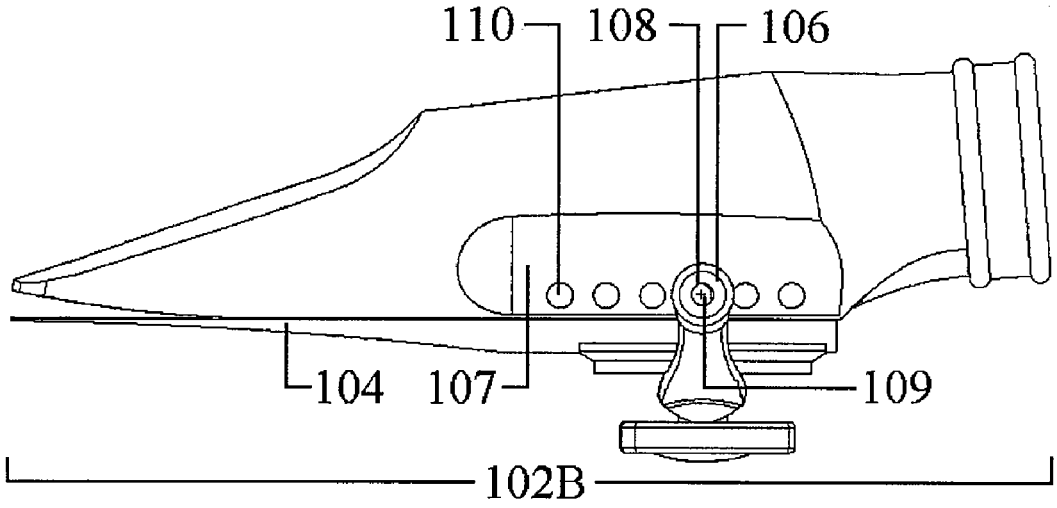
FIG. 2 shows side view of a mouthpiece with the ligature of FIG. 1.
Figure 2A:
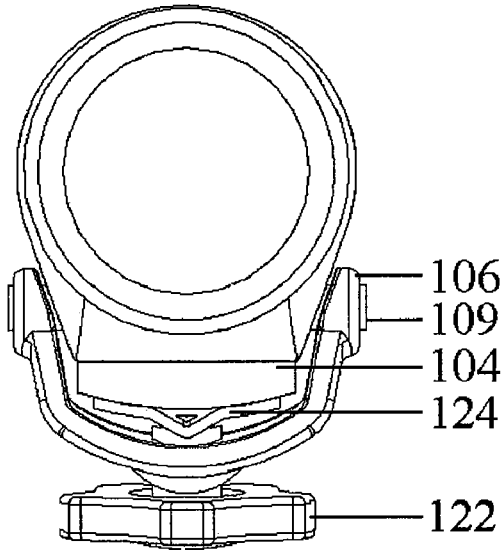
FIG. 2A shows an end view of the mouthpiece of FIG. 2.

Referring to FIGS. 1, 2 and 2A, a ligature 100 constructed in accordance with this invention includes a saddle 101 terminating in two arms 108, each arm having a transversal threaded hole 108. The holes accept corresponding set screws 109. A thumb screw 122 is rotatably mounted on the saddle 101 and can be used to selectively raise and lower a rail 124.

The ligature 100 is used to mount a reed 104 on a mouthpiece 102B. Mouthpiece 102B has two elongated sections 107 on its sides, each section 107 being formed with holes 110 spaced longitudinally. The holes are sized so that the screws 109 can loosely fit into holes 110. Once positioned, the screws 109, held securely in the ligature by threaded holes 108 in the ligature, hold the ligature securely in place along mouthpiece 102B by immovably fitting in holes 110. This allows the ligature to vibrate freely in relation to the mouthpiece, while still securely being held in place.

As shown in FIGS. 2 and 2A, the ligature 100 is used to secure the reed 104 to the mouthpiece 102B. More particularly, when thumbscrew 122 is tightened, it clamps the reed 104 between rail 124 and the outer surface of the mouthpiece 102B in the normal manner. Importantly, by screwing and unscrewing set screws 109 the ligature can be selectively attached and detached from the mouthpiece 102B by engaging one of the pairs of holes 108 (one hole is engaged on each side of the mouthpiece 102B). Therefore the ligature can be positioned at any one of several positions defined by the holes 110. Moreover, once a musician determines which positions he likes, he can then leave the ligature and the reed set in the same position all the time guaranteeing his favorite position at each next use.

Most importantly because the set-screws 109 are loose inside the holes 108 only minimal contact, and NO frictional contact, is had with the mouthpiece body 102B. This allows the reed 104 and ligature body 106 combination to vibrate independently from the mouthpiece body 102B and a free, open, and resonant resultant sound to be produced.

Of course other means can be used to engage the ligature to the mouthpiece. For example, the set screw can be replaced by a spring-loaded shaft that can be easily inserted into and withdrawn from holes 110. Further, the set screws could be loose inside the ligature holes 108 and screw into threaded holes 110. Numerous modifications can be made to the invention without departing from the scope defined in the appended claims.

I claim:

1. A mouthpiece assembly for a musical instrument comprising:

a mouthpiece having a longitudinal side; and a ligature having a clamping member for clamping a reed to the mouthpiece, said ligature and said mouthpiece being constructed to define a plurality of longitudinally spaced positions for said ligatures;

wherein said mouthpiece is formed with a plurality of longitudinally spaced holes and said ligature has a movable shaft that is selectively advanced and retracted with respect to said holes.

2. The assembly of claim 1 wherein one of said holes and said shaft is threaded.

3. A mouthpiece assembly comprising:

an elongated mouthpiece having a circumferential wall with two opposed longitudinal sections formed with position defining elements;

a ligature mounted on said circumferential wall in one of several longitudinally spaced discrete positions defined by said position defining elements along said circumferential wall; and a reed selectively secured to said mouthpiece by said ligature.

4. The assembly of claim 3 wherein said position defining elements are pairs of holes.

5. The assembly of claim 4 wherein said ligature is formed with set screws selectively engaging said holes.

6. The assembly of claim 3 wherein said ligature has a U-shaped body.

7. The assembly of claim 3 wherein said mouthpiece is formed with a plurality of positioning holes spaced along the mouthpiece body and said ligature is formed with a transversal hole and a set screw, said transversal hole being arranged to receive said set screw and being positioned adjacent to one of said positioning holes.

* * * * *